United States Patent [19]

Markowitz et al.

[11] 4,072,173

[45] Feb. 7, 1978

[54] WEAVING BOARD

[76] Inventors: Allan H. Markowitz, 2650 Country Club Drive, Glendora, Calif. 91740; Matilda Macknin, 9514 E. Kennerly St., Temple City, Calif. 91780

[21] Appl. No.: 782,777

[22] Filed: Mar. 30, 1977

[51] Int. Cl.[2] ..... D03D 29/00

[52] U.S. Cl. ..... 139/34; 28/151

[58] Field of Search ..... 139/29, 33, 34; 28/149, 28/151, 152

[56] References Cited

U.S. PATENT DOCUMENTS

| | | | |
|---|---|---|---|
| 1,975,924 | 10/1934 | Collingbourne | 28/15 |
| 2,077,531 | 4/1937 | Rossiter | 139/34 |
| 2,663,066 | 12/1953 | Berger et al. | 28/15 |
| 2,802,255 | 8/1957 | Wallach | 28/15 |
| 2,817,139 | 12/1957 | Morin | 139/34 |

*Primary Examiner*—Henry S. Jaudon

*Attorney, Agent, or Firm*—Christie, Parker & Hale

[57] ABSTRACT

A weaving board includes a flat base, a first pair of longitudinally spaced apart ridges projecting from one side of the base, and a second pair of ridges projecting from an opposite side of the base. The ridges on each side of the base are located relatively near the opposite ends of the base, and each ridge is continuous for the width of the base. Separate series of grooves are formed in opposite ends of the base. The grooves are preferably wider than the spacing between them; and preferably, the projections formed between the grooves are rounded at their remote ends. The grooves segregate separate rows of warp yarns extending lengthwise around the board and over the ridges. The ridges space the warp yarns from the opposite sides of the board to provide room for weaving consecutive rows of woof of weft yarns through the warp yarns.

20 Claims, 4 Drawing Figures

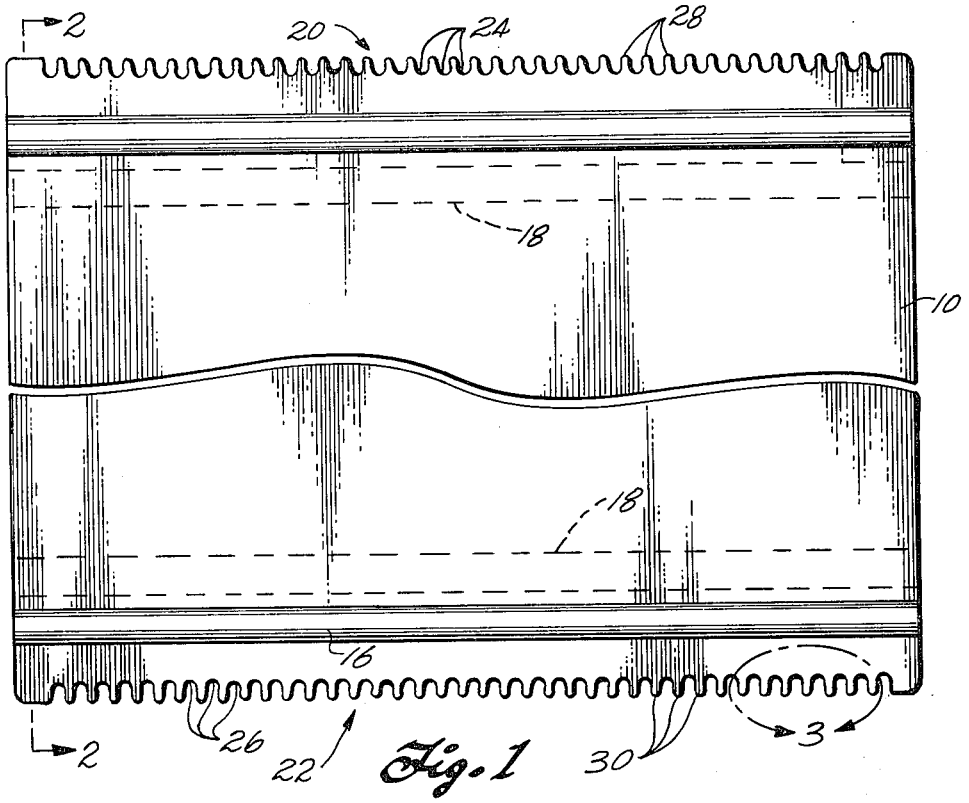
Fig. 1
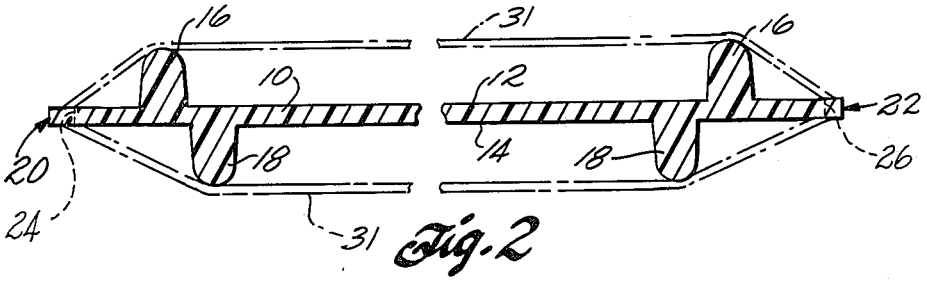
Fig. 2
Fig. 3
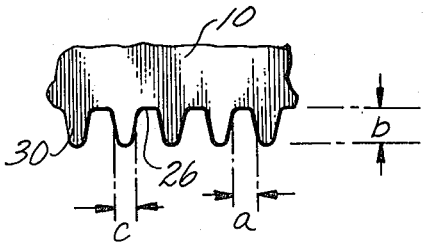
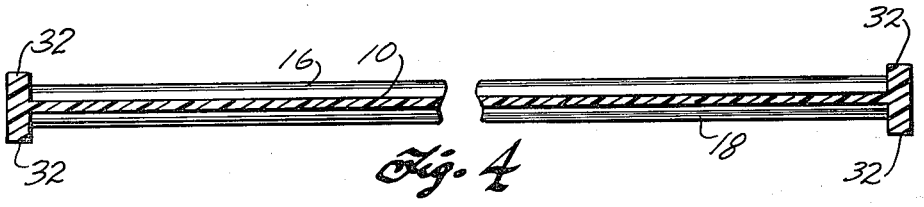
Fig. 4

WEAVING BOARD

BACKGROUND OF THE INVENTION

This invention relates to a weaving board for holding yarn or cord, for example, to be woven into a pattern on the board.

Thread-like material, such as yarn or cord, can be woven into a desired pattern on a hand-held board referred to herein as a weaving board. A weaving pattern typically consists of side-by-side rows of "warp" yarns extending lengthwise along the weaving board. The warp yarns are crossed by successive rows of "woof" or "weft" yarns woven through the warp yarns in any desired pattern.

A weaving board holds the rows of warp yarns in a fixed position, separating them from one another to facilitate weaving the woof or weft yarns through the fixed warp yarns. The woof or weft yarns are typically secured to a hand-held shuttle which is then used to weave the woof or weft yarns through the warp yarns.

The weaving board of this invention holds the warp yarns so they are spaced from the main base structure of the weaving board. This enables the user to fit his or her hand under the warp yarns and move the shuttle under and over selected warp yarns when weaving the woof or weft yarns across the board.

This invention is based on a recognition of a need for a weaving board which (1) reduces the chance of snagging the yarns secured to the board, (2) facilitates using different types of weaving material in a variety of selected weaving patterns on the same board, (3) enables the user to weave on the same board as large a continuous piece of woven material as possible, within practical limits, and (4) securely holds the warp yarns in a fixed position on the board as the woof or weft yarns are being woven.

SUMMARY

Briefly, this invention provides a weaving board having a generally planar base with opposed first and second surfaces, and longitudinally spaced apart first and second edges extending across the width of the base. A pair of first ridges are spaced apart lengthwise and project away from the first surface of the base, and a pair of second ridges are spaced apart lengthwise and project away from the second surface of the base. The first and second ridges are substantially continuous across the width of the base. A first series of laterally spaced apart grooves are formed in the first edge of the base, and a second series of laterally spaced apart grooves are formed in the second edge of the base. The width of each groove is greater than the spacing between adjacent grooves in each series.

Preferably, each edge has a series of laterally spaced apart outward projections between the grooves, and the outward extent of the projections in each series is rounded. Moreover, the inward extent of each groove is preferably rounded.

The greater width of the grooves, compared to the spacing between them, facilitates weaving yarns or cords in a wide range of sizes. Further, the wider grooves enable the user to weave a large number of patterns. For example, the board facilitates using multiple yarns in each warp of the woven pattern. In addition to the versatility provided by the weaving board, the rounded projections between the grooves reduce the chance of snagging the warp yarns secured to the board. Further, the arrangement of grooves and ridges at opposite ends and on opposite sides of the board, respectively, facilitate weaving on both sides of the board, thereby permitting the user to weave a continuous piece of woven material having twice the area of the weaving board.

These and other aspects of the invention will be more fully understood by referring to the following detailed description and the accompanying drawing.

DRAWING

FIG. 1 is a fragmentary plan view showing a weaving board according to principles of this invention;

FIG. 2 is a fragmentary, cross-sectional elevation view taken on line 2—2 of FIG. 1;

FIG. 3 is an enlarged, fragmentary plan view showing the portion of the board within the circle 3 of FIG. 1; and FIG. 4 is a fragmentary, cross-sectional elevation view showing an alternate embodiment of the weaving board.

DETAILED DESCRIPTION

Referring to FIG. 1, a weaving board according to this invention comprises an elongated, relatively thin, flat base structure 10 which is preferably rectangular in shape. The long dimension of the base 10 is viewed in FIG. 2, which illustrates a first or upper flat surface 12 and a second or lower flat surface 14. A pair of longitudinally spaced apart first ridges 16 project away from the upper surface 12 of the base 10, and a pair of longitudinally spaced apart second ridges 18 project away from the lower surface 14 of the base 10. The first and second ridges 16, 18 are all parallel to one another across the width, i.e., the short dimension, of the base; and the ridges are continuous across the width of the base. The remote edge of each ridge is rounded, and each ridge is uniform in height across the width of the base.

As shown best in FIG. 2, the first ridges 16 are spaced wider apart than the second ridges 18 so that each ridge is offset longitudinally from the corresponding ridge on the opposite side of the base.

As shown best in FIG. 2, the base 10 has opposed first and second edges 20, 22, respectively, extending across the width of the base. One corresponding pair of first and second ridges are located relatively nearer the first edge 20, and the other corresponding pair of first and second ridges are located relatively nearer the second edge 22. The major lengthwise extent of the weaving board is between the first ridges 16, or the second ridges 18. That is, the distance from each ridge to its adjacent edge is relatively short compared to the distance between the first ridges, or the second ridges.

A series of laterally spaced apart grooves 24 are formed along the first edge 20 of the base, and a second and identical series of grooves 26 are formed along the second edge 22 of the base. The first and second series of grooves have a substantially uniform width, and the width of each groove is preferably greater than the spacing between adjacent grooves. Further, the depth of each groove is preferably greater than the width of the groove, or the spacing between them.

The spaced apart grooves form respective series of outwardly extending, laterally spaced apart first and second projections 28, 30, along the first and second edges of the board, respectively.

FIG. 3 shows the detailed structure of the grooves and projections along the second edge 22 of the board. The tips of the second series of projections 30 are rounded, and the inner edges of the second series of grooves 24 also are rounded. The structure of the grooves and projections along the first edge 20 is identical.

Preferably, the weaving board is made from a hard plastic material capable of being injection-molded as an integral unit. As to the preferred dimensions of the weaving board, the base 10 is preferably 18 inches long by 13½ inches wide. The grooves 24, 26 preferably are 3/16-inch wide (dimension a for grooves 26 shown in FIG. 3), and the depth of the grooves (dimension *b* for grooves 26 shown in FIG. 3) is preferably ¼ inch. The projections 28, 30, i.e., the spacing between the grooves (dimension c for the projections 30 shown in FIG. 3) are preferably ⅛ inch wide. The dimension *c* is an average distance because the projections 28, 30 are slightly tapered narrower toward their outer ends. The first and second ridges 16, 18 are preferably ½ inch in height, and each first ridge is offset longitudinally from its corresponding second ridge by a distance of preferably 3/16 inch. The longitudinal distance between the first ridges is 15½ inches, and the first ridges are located about ¾ inch inboard the outer edges of the board. The preferred thickness of the base is ⅛ inch. Preferably, there are between 37 to 40 grooves on each edge of the weaving board, depending upon the width of the ungrooved margin along each edge of the board.

In using the weaving board, rows of warp yarns (illustrated in phantom lines at 31 in FIG. 2) are wrapped longitudinally around the weaving board. Each row of warp yarns is registered in a corresponding pair of grooves 24, 26 at opposite ends of the board. The warp yarns 31 rest on the top edges of the first and second ridges 16, 18, as illustrated in FIG. 2. The grooves 24, 26 separate the warp yarns 31 and hold them in separate fixed parallel positions spaced from one another across the width of the board. The ridges space the warp yarns from the upper and lower surfaces 12, 14 of the board. This provides room for the user to fit his or her hands, as well as the weaving shuttle (not shown) under the warp yarns 31 on each side of the board when weaving the woof or weft yarns through the rows of warp yarns. The wider width of the grooves 24, 26, compared to the spacing between them, maximizes the number of grooves across the width of the board while facilitating the use of yarn, cord, or other weaving material of a wide range of sizes. Further, the wider grooves permit the use of multiple yarns, cord, or the like in each warp row, which permits the user to weave a wide range of patterns. The rounded tips of the projections between the grooves inhibits snagging of the yarn, when compared with weaving boards having sharp corners, or slits in which the yarn is forced to make a tight friction fit to hold it on the board. The ridges on opposite sides of the weaving board permit weaving on both sides of the board which maximizes the continuous length of woven material produced on the board. The offset orientation of the first ridges from the second ridges permits ease of stacking the weaving boards for shipment.

FIG. 4 illustrates an alternate form of the invention in which the marginal longitudinal edges of the weaving board have upwardly and downwardly extending flanges 32 extending continuously for the length of the board. The flanges extend beyond the remote edges of the upper and lower ridges 16, 18 to prevent warp material resting on the ridges from sliding off the edge of the board, especially when the weft or woof yarns are being woven. Further, the flanges permit the weaving board to be set down without resting on the material woven on the board, which can prevent snagging or wear on the woven material.

We claim:

1. A weaving board comprising:

a generally planar base having opposed first and second surfaces, the base having longitudinally spaced apart first and second edges extending across the width of the base;

a pair of first ridges spaced apart longitudinally and projecting from the first surface of the base;

a pair of second ridges spaced apart longitudinally and projecting from the second surface of the base;

the first and second ridges being substantially continuous across the width of the base;

a first series of laterally spaced apart grooves formed in the first edge of the base;

a second series of laterally spaced apart grooves formed in the second edge of the base;

the width of each groove being greater than the spacing between adjacent grooves in each series;

a pair of laterally spaced apart elongated first flanges extending longitudinally along opposite edges of the base and projecting from the first surface thereof beyond the remote edges of the first ridges; and a pair of laterally spaced apart second flanges extending along opposite edges of the base and projecting from the second surface thereof beyond the remote edges of the second ridges.

2. Apparatus according to claim 1 in which each of the laterally spaced apart outward projections formed between the grooves has an outward extent which is rounded.

3. Apparatus according to claim 2 in which the inward extent of each groove is rounded.

4. Apparatus according to claim 2 in which the edge of each ridge remote from the plane of the base is rounded.

5. Apparatus according to claim 1 in which each of the laterally spaced apart outward projections formed between the grooves has an outward extent which is rounded.

6. Apparatus according to claim 1 in which the longitudinal distance between the first ridges and the longitudinal distance between the second ridges are both substantially greater than the distance from each ridge to the adjacent edge of the base.

7. Apparatus according to claim 1 in which the base is made of hard plastic.

8. Apparatus according to claim 7 in which the ridges are integrally formed with the base.

9. Apparatus according to claim 8 in which each of the laterally spaced apart outward projections formed between the grooves has an outward extent which is rounded.

10. Apparatus according to claim 9 in which the inward extent of each groove is rounded.

11. Apparatus according to claim 9 in which the edge of each ridge remote from the plane of the base is rounded.

12. A weaving board comprising:

a generally planar, elongated baseboard having opposed first and second planar surfaces and having longitudinally spaced apart first and second edges extending across the width of the baseboard;

a pair of first ridges spaced apart longitudinally and projecting from the first surface of the baseboard;

a pair of second ridges spaced apart longitudinally and projecting from the second surface of the baseboard;

the first and second ridges having generally smooth remote surfaces spaced from the plane of the baseboard and being continuous substantially across the width of the baseboard;

the longitudinal distance between the first ridges and the longitudinal distance between the second ridges both being greater than the distance from each ridge to the adjacent edge of the baseboard; and a first series of laterally spaced apart grooves formed in the first edge of the baseboard, and a second series of laterally spaced apart grooves formed in the second edge of the baseboard.

13. Apparatus according to claim 12 in which each of the laterally spaced apart outward projections formed between the grooves has an outward extent which is rounded.

14. Apparatus according to claim 13 in which the inward extent of each groove is rounded.

15. Apparatus according to claim 12 in which the ridges are stationary and substantially rigid; and in which the remote edge of each such ridge is rounded.

16. Apparatus according to claim 12 in which the baseboard and the ridges are made of hard plastic and the ridges are integrally formed with the base.

17. Apparatus according to claim 16 in which the width of each groove is greater than the spacing between adjacent grooves in each series.

18. Apparatus according to claim 17 in which each of the laterally spaced apart outward projections formed between the grooves has an outward extent which is rounded; and the inward extent of each groove is rounded.

19. Apparatus according to claim 16 in which the remote edge of each ridge is rounded.

20. Apparatus according to claim 12 in which the width of each groove is greater than the spacing between adjacent grooves in each series.

* * * * *